United States Patent [19]

Cherry

[11] Patent Number: 4,488,326

[45] Date of Patent: Dec. 18, 1984

[54] PALLET DOCK LIFT

[75] Inventor: Charles W. Cherry, Edmond, Okla.

[73] Assignee: Autoquip Corporation, Guthrie, Okla.

[21] Appl. No.: 431,249

[22] Filed: Sep. 30, 1982

[51] Int. Cl.[3] ..... E01D 1/00

[52] U.S. Cl. ..... 14/72.5; 14/69.5; 182/113; 182/141; 414/495

[58] Field of Search ..... 14/69.5, 71.1, 71.3, 14/71.5, 71.7, 72.5; 414/495, 537; 182/113; 74/100 R

[56] References Cited

U.S. PATENT DOCUMENTS

| | | | |
|---|---|---|---|
| Re. 25,249 | 10/1962 | Kelley | 14/71.1 |
| 2,289,844 | 7/1942 | Lamb | 182/113 |
| 2,873,904 | 2/1959 | McCormick | 14/71.1 X |
| 3,233,767 | 2/1966 | Goodacre | 14/72.5 X |
| 3,252,344 | 5/1966 | Benson | 74/100 R |
| 3,444,574 | 5/1969 | LeClear | 14/71.3 |
| 3,493,078 | 2/1970 | Allegri et al. | 182/113 |
| 3,553,756 | 1/1971 | Hecker, Jr. et al. | 14/71.3 |
| 3,806,092 | 4/1974 | Richards | 414/495 X |
| 3,883,917 | 5/1975 | Alten | 14/71.3 |
| 4,010,826 | 3/1977 | Jones | 414/495 |
| 4,110,860 | 9/1978 | Neff et al. | 14/71.7 |

*Primary Examiner*—Stephen J. Novosad
*Assistant Examiner*—Beverly E. Hjorth
*Attorney, Agent, or Firm*—Niro, Jager & Scavone

[57] ABSTRACT

An ambulatory power lift including a base and a movable lifting platform connected by a scissor lever assembly. Hydraulic power cylinders expand said scissor assembly in a manner which applies a substantially vertical lifting force to said platform. A modular power unit directs hydraulic fluid to said cylinders and allows the remote control of the lifting operation. A retractable bridge assembly on one end of the platform automatically raises as said lift is lowered, and a retractable wheel assembly allows the lift to be selectively transported in a lowered condition. A retractable guardrail closes at least one end of the lift platform. Safety means are also provided to prevent tampering with said power unit and to prevent entrapment between the platform and base.

33 Claims, 23 Drawing Figures

74
10
74
50
50
75
74
70B
70A
80
64
60
67
66
69
51
134
132
138
130
136
84
130
132
51
138
134
136
82
40
40
54
44
44
54
46
44
56
56
49
49
22
22
42
52
20
24
42

70B
75
74
76
75

75
70B
74
76

70A
74

74
70A 54
56
29
29
52
42A
28
22
42
28

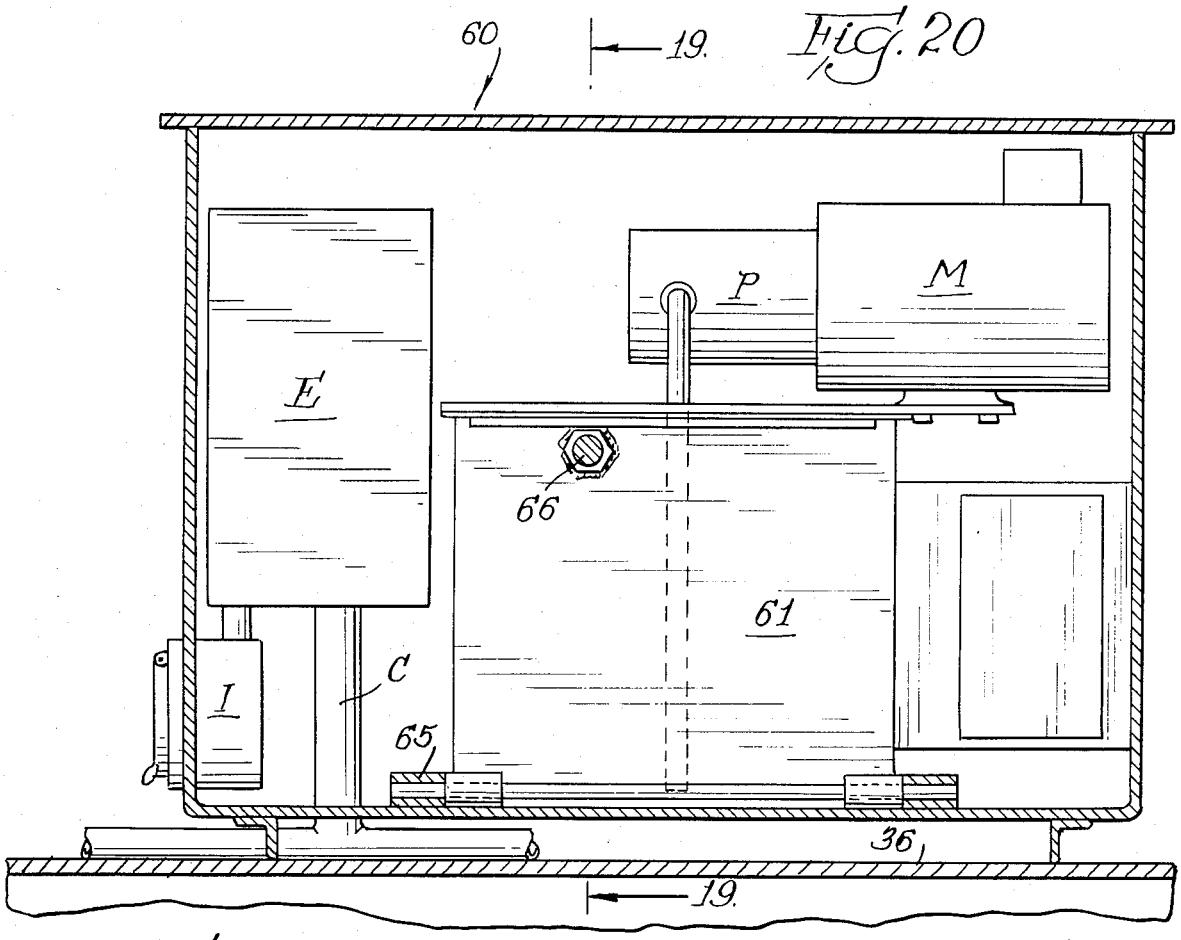
Fig. 20
60
19
E
P
M
66
61
C
I
65
36
19
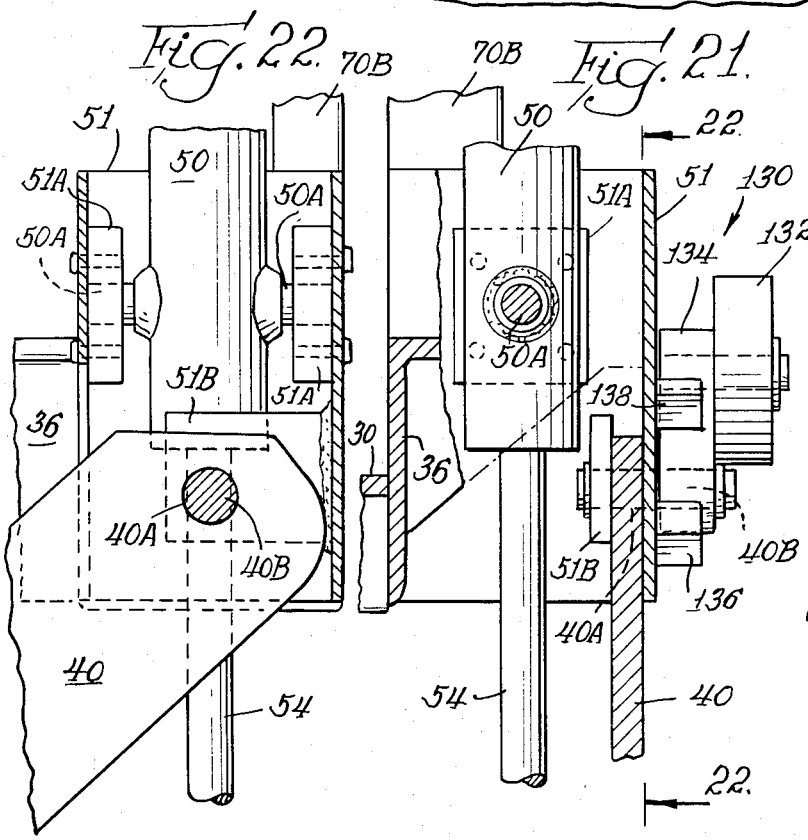
Fig. 22
70B
51
50
51A
50A
51B
36
40A
40B
40
54
Fig. 21
70B
50
22
51A
51
130
134
132
50A
138
30
36
51B
40A
136
40B
54
40
22
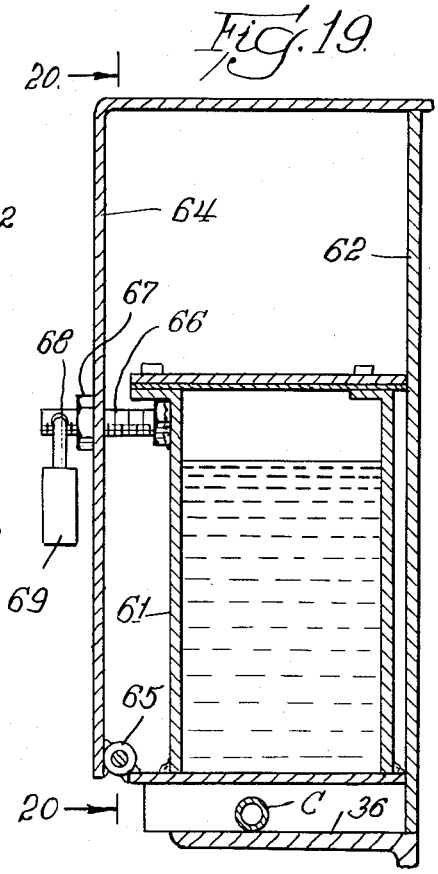
Fig. 19
20
64
62
67
66
68
69
61
65
20
C
36

PALLET DOCK LIFT

This invention relates to a hydraulically powered scissors-type pallet dock lift.

Ambulatory scissors-type dock lifts are generally well known. U.S. Pat. No. 3,806,092 entitled "Wheel Activator for Ambulatory Truck Loading Elevator", issued on Apr. 23, 1974 to the assignee of the present invention, illustrates the construction of a typical dock lift. Engineers in this field are constantly striving to develop improvements for this type of dock lift which make the lift simple and inexpensive to manufacture, operate and maintain. Other desirable design criteria are that the dock lift should have a high operating speed, a high loading capacity and substantial portability. Also, the lift should have a minimum lowered height, to facilitate transport and storage, and should be capable of being elevated vertically without substantial eccentric loading. The above design objections should be accomplished while enhancing the safety of the lift in operation.

This inventon provides an improved pallet dock lift having a novel combination of structural and functional features which substantially satisfy the above design criteria. The lift in accordance with the present invention includes a scissor lifting mechanism which improves the efficiency and capacity of the lift. These features are accomplished by minimizing eccentric loading and assuring that the movement of the lift is in a truly vertical direction of travel. Also, efficiencies in design, manufacture and operation result from the provision of easily accessible and adjustable portable support wheels for the lift; by the addition of an automatic throw-over bridge retractor assembly; and by the incorporation of a modular, lockable power unit for operating the lift. The safety features of the lift in accordance with this invention are improved by the provision of the above-described rectractable bridge, as well as by the use of such features as streamlined, retractable guardrails and toe guard devices. These features reduce the possibility of accidental injury to the lift operators. The resulting lift is capable of high-speed, vertical lifting operations, and can be folded into a compact unit of minimum height for transportation or storage.

ILLUSTRATIVE EMBODIMENT

Further objects and features of the present invention will become apparent from the description of an illustrative embodiment thereof, taken in conjunction with the accompanying drawings, in which:

FIG. 19 is a sectional elevational view of the modular power unit provided on the lift, as viewed along the line 19—19 in FIG. 2 and line 19—19 in FIG. 20;

FIG. 20 is a sectional view of the modular power unit, as viewed along the line 20—20 in FIG. 19;

FIG. 21 is an enlarged partial sectional view, taken along the line 21—21 in FIG. 2, showing the details for mounting the wheel assemblies, the hydraulic cylinders and the scissor levers to the upper movable platform; and FIG. 22 is a sectional side view taken along the line 22—22 in FIG. 21.

Figure 1:
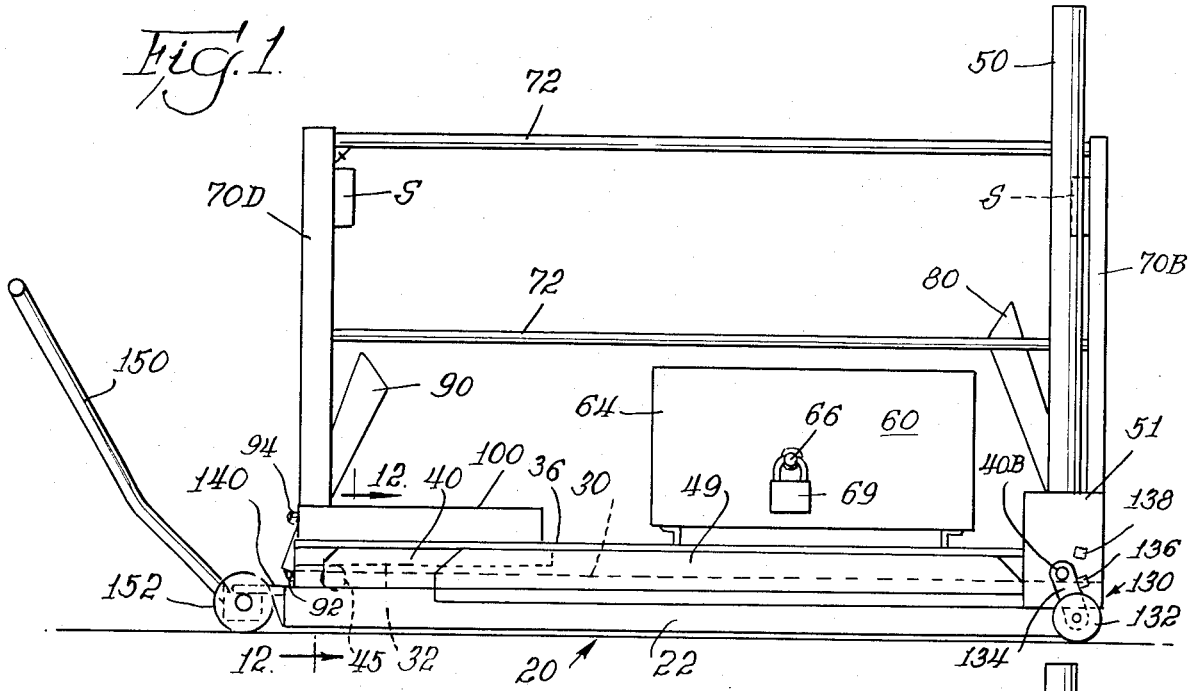
FIG. 1 is a side elevational view of the pallet dock lift in accordance with this invention shown in a lowered transport condition with the lift wheels in contact with the floor and a removable transport dolly attached.

The pallet dock lift incorporating the features and advantages of the present invention is generally indicated in the drawings by the reference numeral 10. This dock lift 10 generally comprises a lower frame or base 20 which is adapted to be supported on a floor or the ground during the lifting operations. The lift 10 further includes an upper movable platform 30 which can be elevated and lowered with respect to the base 20 during the loading operations. A pair of scissor levers 40 and 42 is provided along each side of the lift 10 to connect the upper movable platform 30 with the lower base 20. Similarly, hydraulic cylinder assemblies 50 are provided on the lift 10 to raise and lower the movable platform 30 with respect to the base 20. One cylinder assembly 50 is mounted on each side of the lift 10, at one end of the lift. In the illustrated embodiment, the hydraulic cylinders 50 are provided at the right end of the lift 10 shown in the drawings. This right end is designed in the illustrated embodiment for normal use as the entrance end of the lift 10 through which products are moved from the lift to a fixed dock, or vice versa. The left end of the illustrated lift 10 is normally positioned next to the truck which is to be loaded or unloaded.

In accordance with this invention, the lift 10 further includes a modular power assembly 60 positioned on the movable platform 30 and containing hydraulic controls for operating the lift 10. A remote control switch 'S' is positioned at each end of the platform 30. The switches 'S' are connected to the power unit 60 and permit the lift 10 to be energized by an operator standing in a normal upright position on either end of the platform 30. As seen from FIGS. 1 and 8, the power assembly 60 is located on one side of the platform 30 in a position which does not interfere with the normal loading and unloading of material onto the platform.

Figure 2:
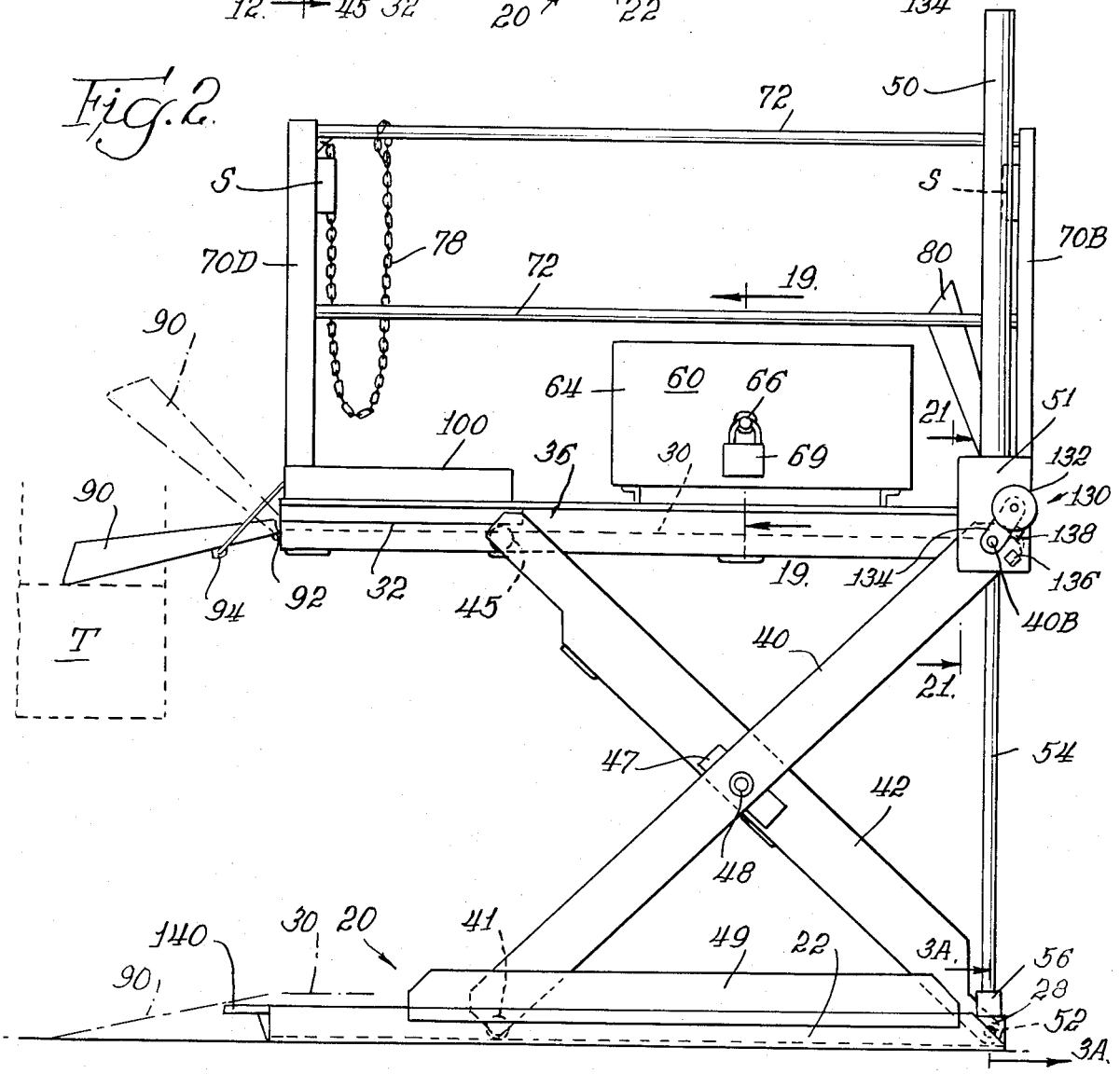
FIG. 2 is a side elevational view of the lift shown in FIG. 1, illustrating the lift in an elevated position with the transport wheels retracted and the throw-over bridge lowered into loading position with respect to a dock or truck bed.
Figure 8:
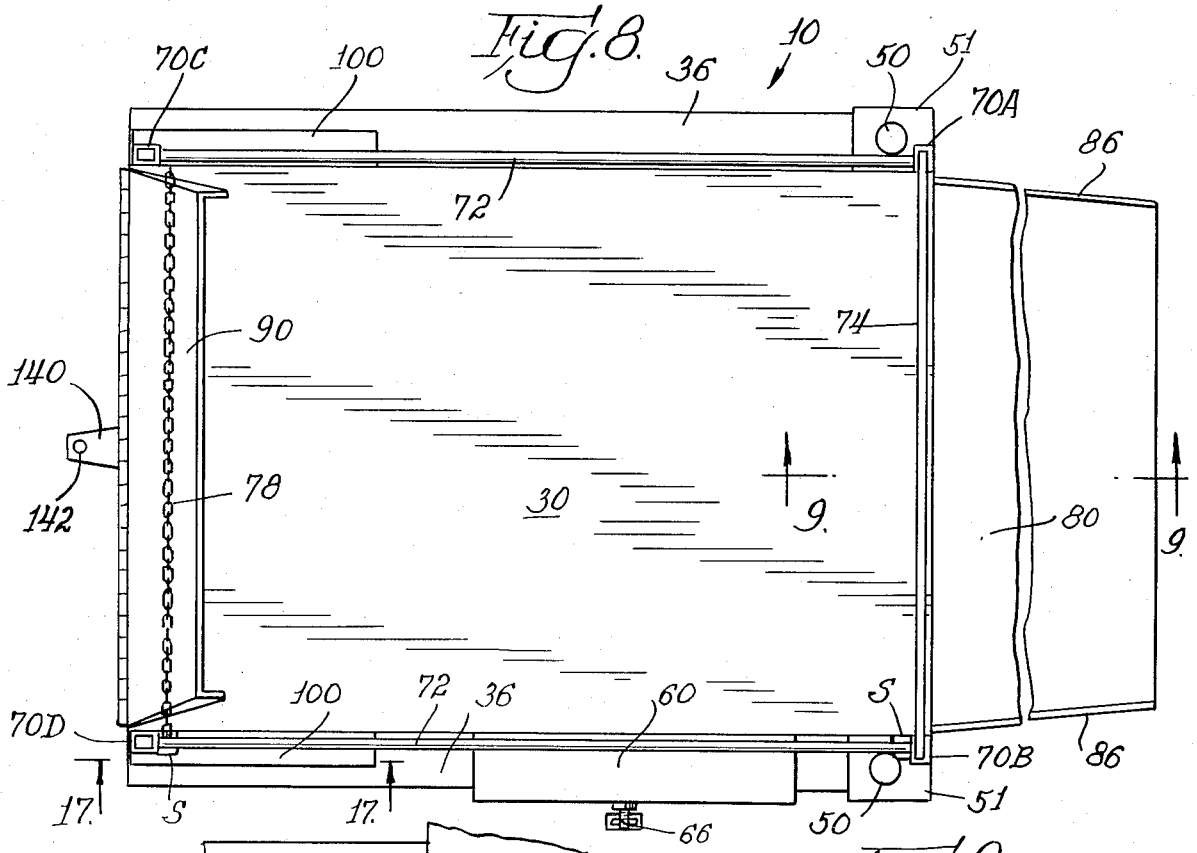
FIG. 8 is a top view of the dock lift in its lowered position, shown with the approach ramp lowered to allow loading of the lift and the throw-over bridge retained in an elevated position.

As illustrated in FIGS. 1, 2 and 8, the platform 30 includes four corner posts 70A–D. These corner posts generally have a box beam construction, and are provided to support the safety rails 72 along each side of the platform 30. In accordance with this invention, the posts 70A and 70B at the right end of the lift 30 also support a retractable guardrail 74. This retractable guardrail 74 extends laterally between the corner posts 70A and B, as shown in phantom in FIG. 3. If desired, a retractable guardrail 74 also can be provided at the left end of the platform 30. However, as shown in the illustrated embodiment, it has been found to be adequate and economical in many situations to provide a safety chain 78, to close the left end of the platform when desired. As explained further below, the retractable bridge 90 also acts as a safety device by automatically closing the lower portion of the left end of the platform 30 as the lift is lowered.

The platform 30 also includes a pivoted approach ramp 80 at the right end. As shown in FIG. 1, the approach ramp 80 can be swung upwardly when the lift 10 is being transported or stored. Upturned side edges 86 on the ramp 80 prevent the material being loaded or unloaded from dropping off the side of the ramp. As further shown in FIGS. 8 and 9, the approach ramp 80 can be lowered, for engagement with the floor or dock, when the lift 10 is in its lowered position. The approach ramp 80 is thus positioned for use in loading and unloading the platform 30. The ramp 80 can be raised into its elevated position, as seen in FIG. 1, when the platform 30 is elevated. Alternatively, the ramp 80 can be suspended in its lowered position by engagement with a stop 82 (FIG. 9) during the elevating operation. The approach ramp 80 can remain in its lowered position during a typical operation because the ramp 80 usually does not have to clear a truck sill as it is elevated.

The left end of the platform 30 includes a throw-over bridge 90. This bridge 90 is pivotally supported on the platform 30 and is designed to extend between the platform and the truck or the like which is being loaded or unloaded by use of the lift 10. As depicted in FIG. 2, the left end of the platform 30 is usually positioned as close as practicable to the truck T being loaded or unloaded. The throw-over bridge 90 therefore should be retracted during the raising and lowering of the platform 30, to clear the adjacent sill of the truck T.

Accordingly, the throw-over bridge 90 incorporates an automatic bridge retractor assembly 100. The retractor assembly 100 operates to automatically retract the bridge 90 as the platform 30 is being lowered, such as when the loading from the truck T has been completed. The bridge 90 thus automatically operates as a wheel chock or guardrail which protects against shifting loads on the platform 30 as the lift 10 is lowered. The retractor assembly 100 also retains the bridge 90 in its retracted position as the platform 30 is being raised.

The lift 10 also includes means for assuring that the lift is portable in its lowered position. In this regard, box frame members 51 provided on the right end of the lift 10 support a pair of retractable wheel assemblies 130 including wheels 132. The wheels 132 are supported on a pivoted lever arm 134, and can be raised when not in use. In the raised position the arm 134 abuts a detent 138. Also, the wheels 132 can be lowered to engage the floor or ground when it is desired to move the lift. In the lowered position each lever arm 134 rests against a detent 136 provided on the adjacent frame member 51. As illustrated in FIGS. 1 and 2, the lever arm 134 is pivotally supported on the lift 10 by means of a pivot pin 40B.

The opposite end of the lift 10 includes a hitching plate 140 having an aperture 142. The plate 140 is adapted to connect to a T-bar dolly assembly 150, as shown in FIG. 1. The dolly 150 includes a pair of wheels 152, and has a conventional construction. When the dolly assembly 150 is in place, and the wheels 132 are lowered, the lift 10 can be transported easily between loading positions, or into storage.

Figure 10:
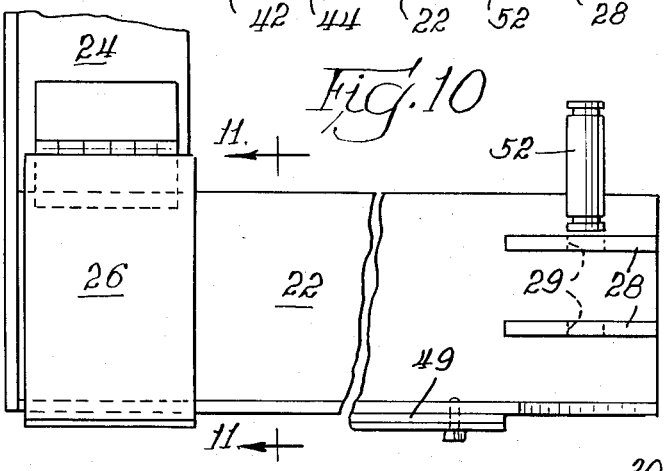
FIG. 10 is a top view of a portion of the lower base for the pallet lift, showing details of a maintenance lock and pivot support plates provided on the base.
Figure 11:
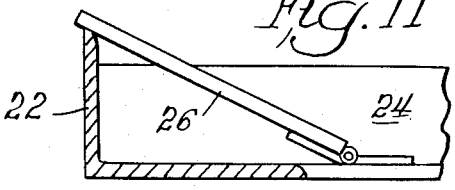
FIG. 11 is a cross-sectional view of the base taken along the line 11—11 in FIG. 10.

Referring to the drawings in more detail, the lift base 20 includes a pair of parallel, longitudinally extending and transversely spaced angle members 22. The left ends of the spaced angles 22 are connected by a cross member 24. The cross member 24 maintains the angles 22 in the proper spacing and also supports the dolly hitching plate 140 in the center of the lift 10. As seen in FIGS. 10 and 11, locking plates 26 are pivotally supported on the cross member 24, and can be pivoted from a position flatly engaged with the angle 24 to a raised, inclined position as shown in FIG. 11. One locking plate 26 is provided on each side of the cross member 24. The plates 26 in their elevated position prevent the complete lowering of the platform 30 onto the base 20. The plates 26, in their raised position, thereby allow maintenance and repair work to be performed safely on lower portions of the lift 10. The elevator platform 30 can be lowered completely only after the plates 26 are intentionally retracted.

Figure 12:
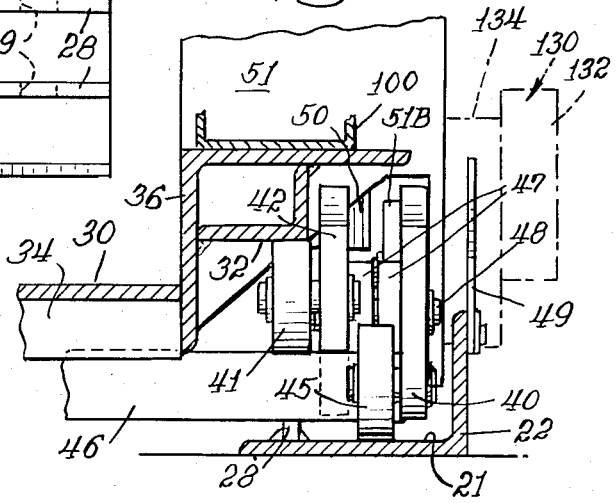
FIG. 12 is an enlarged partial sectional view taken along the line 12—12 in FIG. 1, illustrating the common pivotal mounting for the hydraulic cylinder and scissor levers of the lift; the position of the toe guard; and the nesting of the parts when the lift is in its lowered condition.

The base 20 also includes connections for pivotally mounting the scissor levers 40, 42 on the angle members 22. In this regard, the right end of each angle member 22 includes a pair of spaced mounting plates 28 (FIGS. 10 and 12), having aligned apertures 29. The plates 28 are adapted to receive within the apertures 29 a pin 52, as shown in FIGS. 10 and 12, to pivotally join one pair of scissor levers 40, 42 and one hydraulic cylinder 50 to each of the longitudinal angle members 22.

FIGS. 21 and 22 illustrate that the lower end of each hydraulic cylinder 50 is pivotally supported on the adjacent box frame 51 by a pivot pin 50A. Bearing blocks 51A are bolted or otherwise secured to the frames 51 to provide adequate support for the pins 50A.

Figure 3:
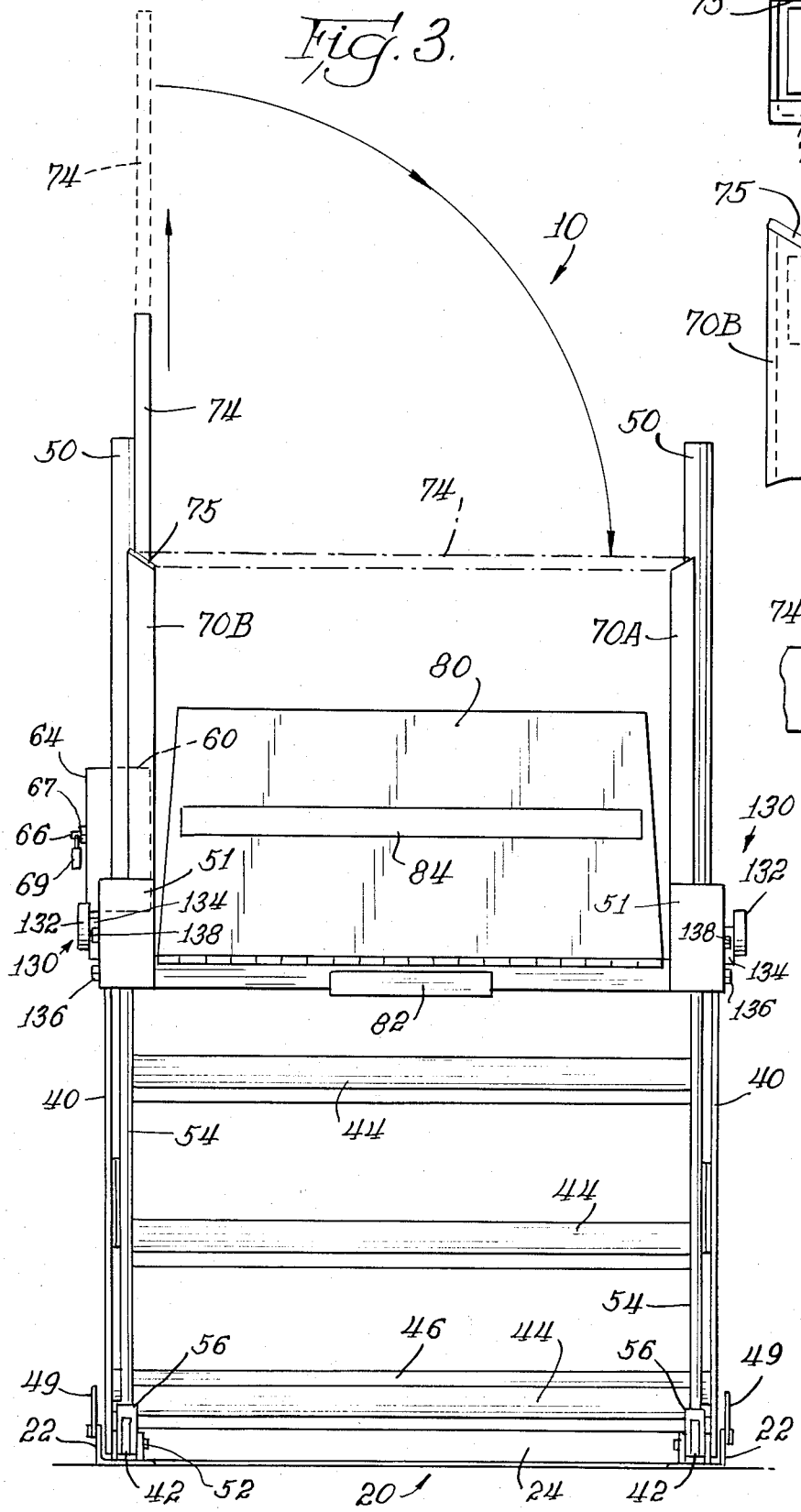
FIG. 3 is a right end view of the lift shown in FIG. 2, illustrating the arrangement of the lifting components which minimizes eccentric loading, and also illustrating the retractable guardrail.
Figure 3A:
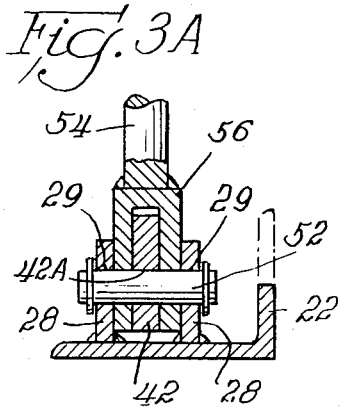
FIG. 3A is a removed sectional view of the pivotal connections used to join the lift components.
Figure 16:
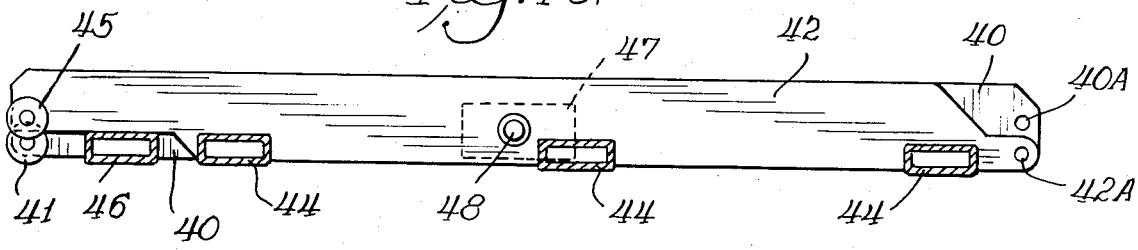
FIG. 16 is a cross-sectional elevational view of the scissor levers taken along the line 16—16 in FIG. 15.

As seen in FIGS. 3 and 3A, each hydraulic cylinder 50 houses a push rod 54 which terminates in a bifurcated clevis 56. The clevis 56 fits within the mounting plates 28, and receives the pin 52 in apertures provided in the clevis. The clevis also receives the reduced end portion of the internal scissor lever 42, as shown in FIGS. 12 and 16. The pin 52 extends similarly through an aperture 42A provided in this reduced end portion of each lever 42.

By this arrangement, the lifting force of the hydraulic cylinder 50 is applied directly and vertically to the scissor lever 42, and to the connected scissor 40, without any substantial eccentric loading. A vertical lifting force is thus more efficiently applied to the platform 30 by the hydraulic cylinders 50. The reduced end portions of the scissor levers 42, as shown in FIG. 16, permit the scissor levers 42 to be elevated by the hydraulic ram 50 without interfering with the movement of the lift 10 by adverse engagement between the lever 42 and the clevis 56. As seen in FIG. 3, this arrangement is the same for both hydraulic cylinders 50 and lower rams 54.

Figure 15:
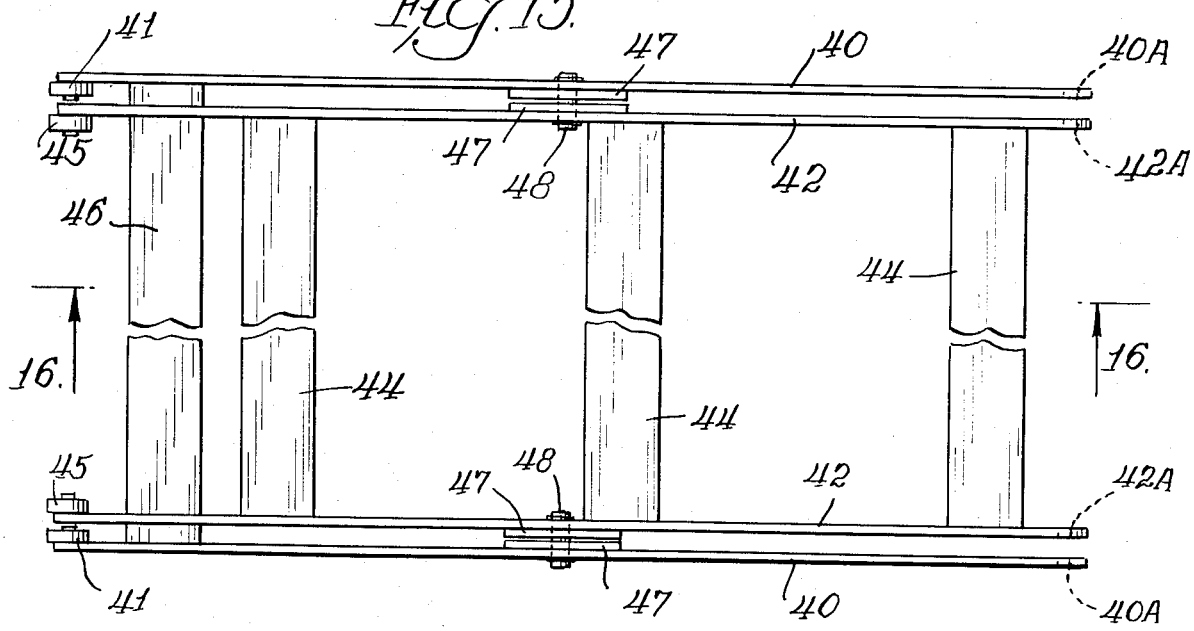
FIG. 15 is a top plan view of the scissor levers shown in the lowered position.

The scissor levers 40, 42 include a series of cross braces which maintain the levers in the proper position and provide strength and rigidity to the levers. In this regard, as seen in FIGS. 15 and 16, cross braces 44 extend between the inner scissor levers 42 at the center and at both ends of the levers. In addition, a cross brace 46 is extended between the free ends of the scissor levers 40 (the left end as viewed in FIGS. 15 and 16). The braces 44 and 46 assure that the levers 40 and 42 maintain the proper position and do not twist or bend during the elevation and lowering of the platform 30 by the operation of the scissor levers. The spacer plates 47 are positioned between the adjacent scissor levers 40 and 42 at the central portion of the levers. As seen clearly in FIG. 15, the plates 47 provide a strong bearing surface for a pivot pin 48 which pivotally joins the central portion of each said of adjacent levers 40, 42. The plates 47 are welded or otherwise secured to the inside central portion of the levers 40 and 42 and may include suitable washers or other low friction surfaces positioned between the plates to facilitate the relative rotary motion between the adjacent levers 40 and 42.

As described above, one end of each of the scissor levers 42 is pivotally supported on a base 20 on the pin 52. The adjacent ends of the other scissor levers 40 are likewise pivotally supported by a pin 40B to the box frame 51 on the lifting platform 30. An internal support plate 51B, as shown in FIGS. 21 and 22, can be provided inside of the frame 51, to support the inner end of the pin 40B. Such a pivot pin 40B, similar to the pin 52 shown in FIG. 10, extends within the apertures 40A provided on the ends of the scissor levers 40, as seen in FIGS. 15 and 16. The opposite free end of the levers 40 include pivoted rollers 41, and the opposite free ends of the scissor levers 42 include pivoted rollers 45. As illustrated in FIGS. 2 and 12, the operation of the hydraulic cylinder 50 causes the scissor levers 40, 42 to open in a scissor fashion to elevate the platform 30. As indicated in FIG. 12, the rollers 41 on the ends of the scissor levers 40 are captured in and ride on a track portion 21 of the lower angle members 22 when the lift 10 is raised or lowered.

In the same regard, the rollers 45 on the end of the scissor levers 42 engage with a track 32 provided on the underside of the lift platform 30. As seen by the comparison of FIGS. 1 and 2, this arrangement for the scissor levers 40, 42 permits the scissor levers to elevate the lift portion 30 by a scissors action when the hydraulic cylinders 50 are extended. During that operation, the levers 40, 42 pivot respectively about their pivot points on the right ends of the base 20 and the platform 30. Simultaneously, the rollers 41 and 45 on the opposite ends of the levers roll on their respective rolling surfaces 21 and 32. When the platform 30 is lowered, by de-energizing the hydraulic cylinders 50, the operation is reversed and the scissor levers 40 and 42 collapse to move the platform 30 to the lowered position shown in FIG. 1.

Figure 9:
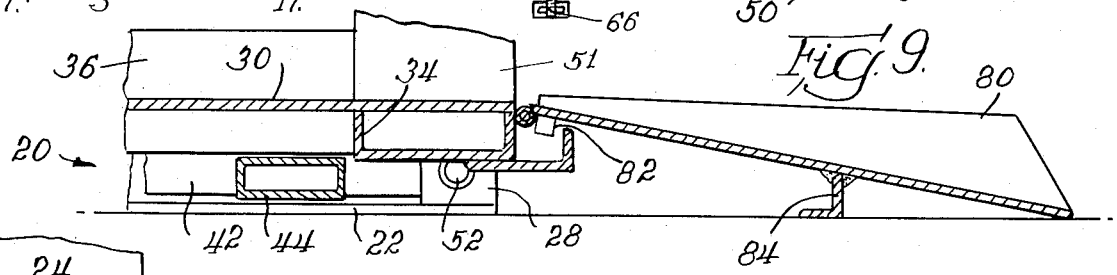
FIG. 9 is an enlarged partial sectional view of the lowered lift and the approach ramp, taken along the line 9—9 in FIG. 8.

As seen in FIGS. 1, 9 and 12, the lowering of the lift 10 drops the platform 30 down into close proximity with the base 20. The scissor levers 40, 42 are also collapsing into alignment with each other. These actions present a danger that an operator could be injured by having a hand or a foot pinned between the moving lift components. To minimize that danger, the lift 10 in accordance with this invention includes a toe guard 49 positioned on each of the angle members 22 of the base 20. The toe guard 49, as seen in FIGS. 1, 2 and 12, is fixed to the member 22 and extends laterally for a substantial extent of the member. The toe guard 49 also extends upwardly from the angle 22 a selected distance so that, as seen in FIG. 12, the guard top portion is adjacent the platform 30 when the platform is being lowered. The guard 49 is preferably made from an inexpensive material such as flexible plastic, but could be made from a more rigid material such as metal. The advantage of plastic is that it will flex and protect against injury if a hand or foot does get trapped between the platform 30 and the guard 49.

The guard 49 also functions to block the entrance to the space between the scissor levers 40, 42 as seen in FIG. 2. Thus, the guard 49 protects against the inadvertent entrapment of an operator's foot in between the levers 40, 42 or the platform 30 and the base 20, as the platform 30 is lowered into position on the base. FIG. 3, illustrates the condition of the toe guards 49 on each side of the base 20, and on the outer portion of the angle members 22, when the platform 30 is raised.

The operation of the hydraulic cylinders 50, to raise and lower the platform 30 is controlled by the power assembly 60. As shown in FIGS. 1 and 2, the assembly 60 is a self-contained unit which is modular and compact. The power unit 60 can thus be positioned on one side of the lift platform 30 adjacent the guardrail at a position which does not interfere with the loading and unloading of the platform. The unit 60 includes a rigid case 62 which houses the hydraulic and electrical systems to operate the lift. This rigid case 62 has a movable cover plate 64 which is mounted on hinges 65. The hinges 65 are recessed to assure that the container 62 is essentially tamperproof.

To further assure that the controls 60 will not be vandalized or broken, the unit includes a hardened steel locking post 66. As shown in FIGS. 19 and 20, the locking post 66 extends through an aperture provided in the cover 64. A nut 67 or other suitable fastener can be secured to the bolt 66 to retain the cover 64 in a secure position closing the container 62. Furthermore, in the preferred embodiment the bolt 66 is provided with an aperture 68 at the outer end which receives the hasp of a padlock 69. By this arrangement, the power unit 60 is contained in a rigid, modular assembly formed from the container 62 and the cover 64. Furthermore, the control components within the unit 60 are readily accessible to authorized personnel by merely unlocking the padlock 69 and opening the cover 64. Normal maintenance and repair can then be performed with ease, without jeopardizing the integrity or security of the modular unit 60.

As shown in FIGS. 19 and 20, the control unit 60 includes a hydraulic resevoir 61 which houses the fluid needed to operate the hydraulic lift cylinders 50. A hydraulic pump 'P' is in fluid communication with the resevoir 61, and functions to direct the hydraulic fluid to and from the cylinders 50 during the operation of the lift 10. A suitable electric motor 'M' is connected to the pump 'P' and is selectively operated to circulate the fluid from the resevoir 61 to and from the cylinders 50. Suitable electrical control circuitry is contained in a control panel 'E' within the power unit 60, and is electrically connected to the motor 'M', to operate the motor during the necessary time intervals. The conduit 'C' extending beyond the walls of the unit 60 connects the electrical control unit to the remote control switches 'S'. Finally, an electric inlet 'I' is provided on the unit 60 electrically coupled to the control panel 'E'. The inlet 'I' provides the panel 60 with means for remotely connecting the panel to an external power source through a suitable electrical cord. Hence, the lift 10 can be transported to a desired location and then simply plugged in to operate the modular control unit 60 in accordance with this invention.

The details of construction of the retractable guardrail 74 as set forth in FIGS. 3 through 7. The guardrail 74 comprises an elongate beam which has a configuration and size selected to be smaller than the size of the associated support posts 70A and 70B. As a result of this dimensional relationship, the guardrail 74 in its retracted position can be stored within the interior of one of the support posts 70A or B. The rail 74 is thereby retained in a position which is accessible to the operator, but which does not interfere with the loading or unloading of the platform 30. When the right end of the platform 30 is to be closed, such as when the lift is being raised or lowered, the guardrail 74 can be withdrawn from the associated post 70B, as shown by the phantom lines in FIG. 3. The rail is then placed across the upper ends of the posts 70A and 70B, to close the adjacent end of the platform 30. To facilitate the securing of the guardrail 74 in the closed position, the upper ends of the posts 70A and 70B are inwardly beveled, as illustrated in FIGS. 4 through 7. The associated ends of the guardrail 74 thereby nest within the beveled upper portions of the posts 70A and B, and are captured from lateral movement by the posts.

Figure 4:
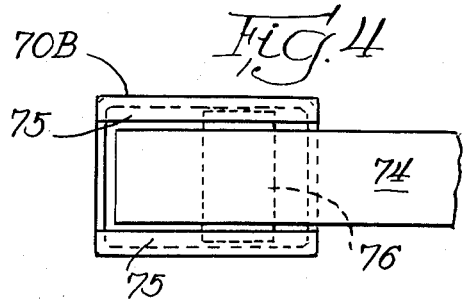
FIG. 4 is a partial top view of the left guardrail post illustrated in FIG. 3, showing the guardrail in its closed position across the adjacent end of the lift.
Figure 5:
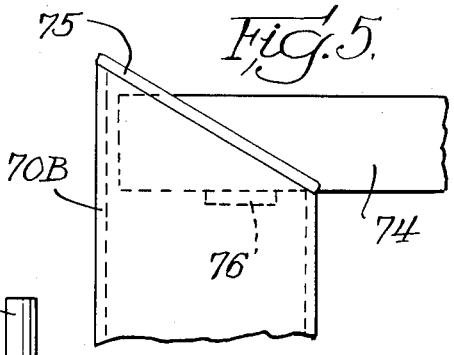
FIG. 5 is an elevational view of the portion of the left guardrail support post illustrated in FIG. 4.
Figure 6:
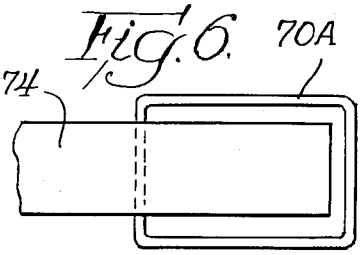
FIG. 6 is a partial top view of the right guardrail support post provided on the lift shown in FIG. 3, shown with the guardrail in the closed position.
Figure 7:
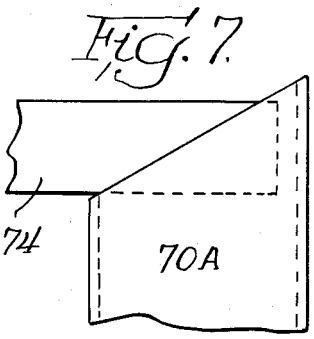
FIG. 7 is an elevational view of the portion of the right support post shown in FIG. 6.

Means are also provided to retain the retractable guardrail 74 in the associated support post 70B. In this regard, as shown in FIGS. 4 and 5, the top beveled portion of the post 70B, in which the guardrail 74 is stored, is provided with a cap plate 75. This cap plate 75 is welded or otherwise secured to the top of the post 70B, and defines an inwardly directed flange. A stop bar 76 is welded to the adjacent end of the guardrail 74. The guardrail including the bar 76 is inserted within the post 70B before the plate 75 is secured to the top of the post. The bar 76 is dimensioned to engage with the flange defined by the plate 75, and to thereby prevent the complete removal of the rail 74 from the post 70B. However, as shown in FIG. 5, the plate 75 and bar 76 cooperate to permit the rail 74 to be pivoted laterally, for extension between the posts 70B and 70A into the closed position. This arrangement provides the lift 10 with an economical retractable guardrail which can be easily stored in an out-of-the-way position during loading, and likewise easily positioned across the end of the lift 10 after the loading has been concluded.

Figure 13:
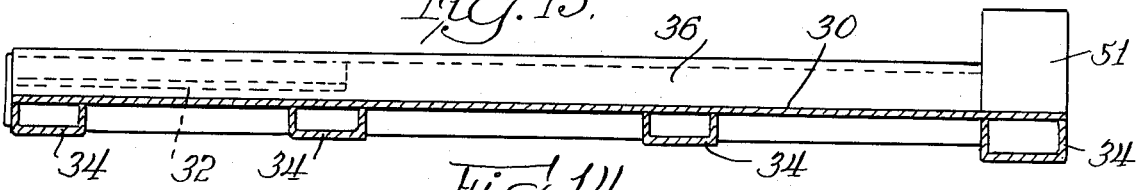
FIG. 13 is a cross-sectional elevational view taken through the upper movable platform of the lift.
Figure 14:
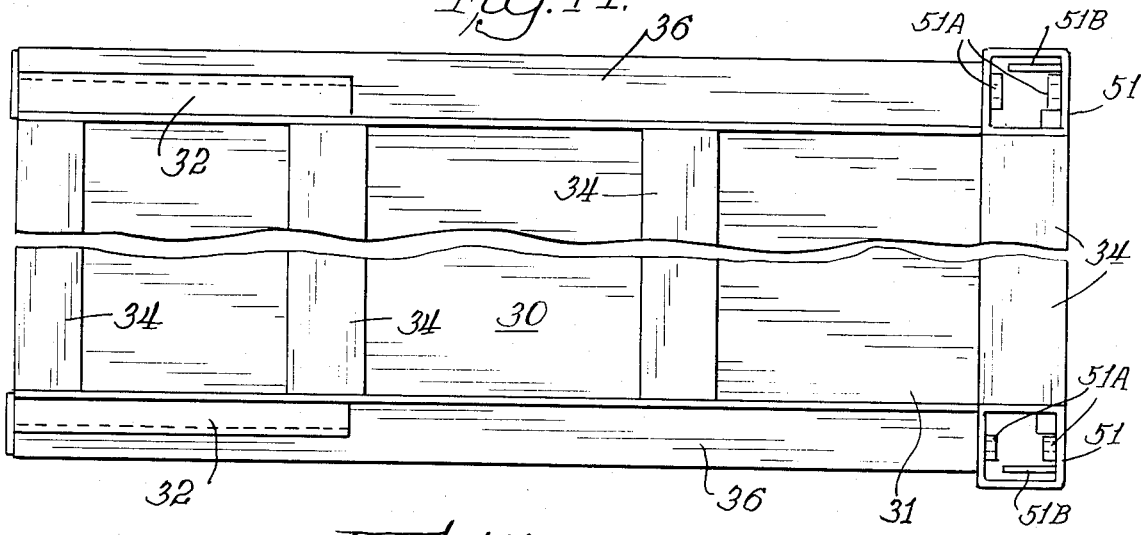
FIG. 14 is a bottom plan view of the upper movable platform illustrated in FIG. 13.

The construction of the lift platform 30 is disclosed in more detail in FIGS. 13 and 14. The platform 30 includes a flat loading surface or deck 31 which is preferably made from high strength steel provided with a non-slip surface configuration. This deck 31 is supported by a plurality of cross beams 34. Longitudinal support beams 36 are also provided along side the deck 31, as shown in FIGS. 1, 2 and 8 to support the lateral edges of the deck. As described above, one end of these longitudinal beams 36 defines the support tracks 32 against which the rollers 45 travel during the operation of the lift 10. The side beams 36 support box frames 51, the corner posts 70A–D, and the guardrails 72.

Figure 17:
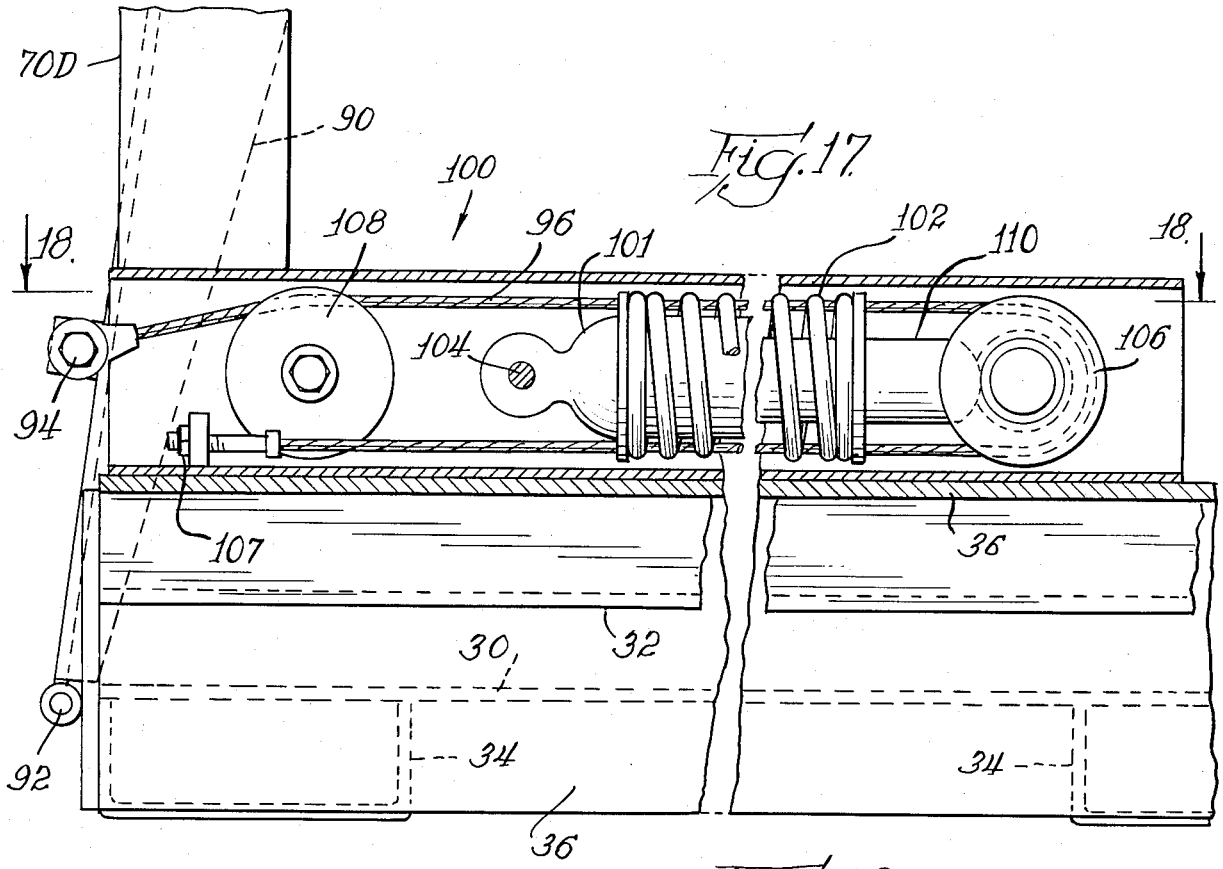
FIG. 17 is an enlarged sectional view taken along the line 17—17 in FIG. 8, illustrating the automatic bridge retractor assembly provided on at least one side of the lift.

In accordance with this invention, the platform 30 also supports the bridge 90 and a pair of automatic bridge retraction units 100. One unit 100 is positioned on each side of the platform 30 above the normal pivot point 92 for the bridge 90. As shown in FIGS. 2 and 17, the pivot point 92 for the bridge 90 is positioned in alignment with the loading surface of the platform 30. Thus, material being loaded from the bed of the truck T over the bridge 90 can be transported directly onto the platform 30. In the normal loading position, bridge 90 is designed to be angled downwardly from the platform 30, at an angle between approximately 30° and 45° to the horizontal, as shown in FIG. 2. This lowered position places a pair of connecting bolts 94, one of which is on each side of the bridge 90, below the pivot point 92 for the bridge, as shown in FIG. 2. Each connecting bolt 94 is secured to a lifting cable 96, so that the cables 96 support the bridge 90 in its lowered position. As also shown clearly in FIG. 2, the hitching plate 140 will also engage with the bridge 90 in its lowered position, and operate as a detent or stop for the bridge.

Figure 18:
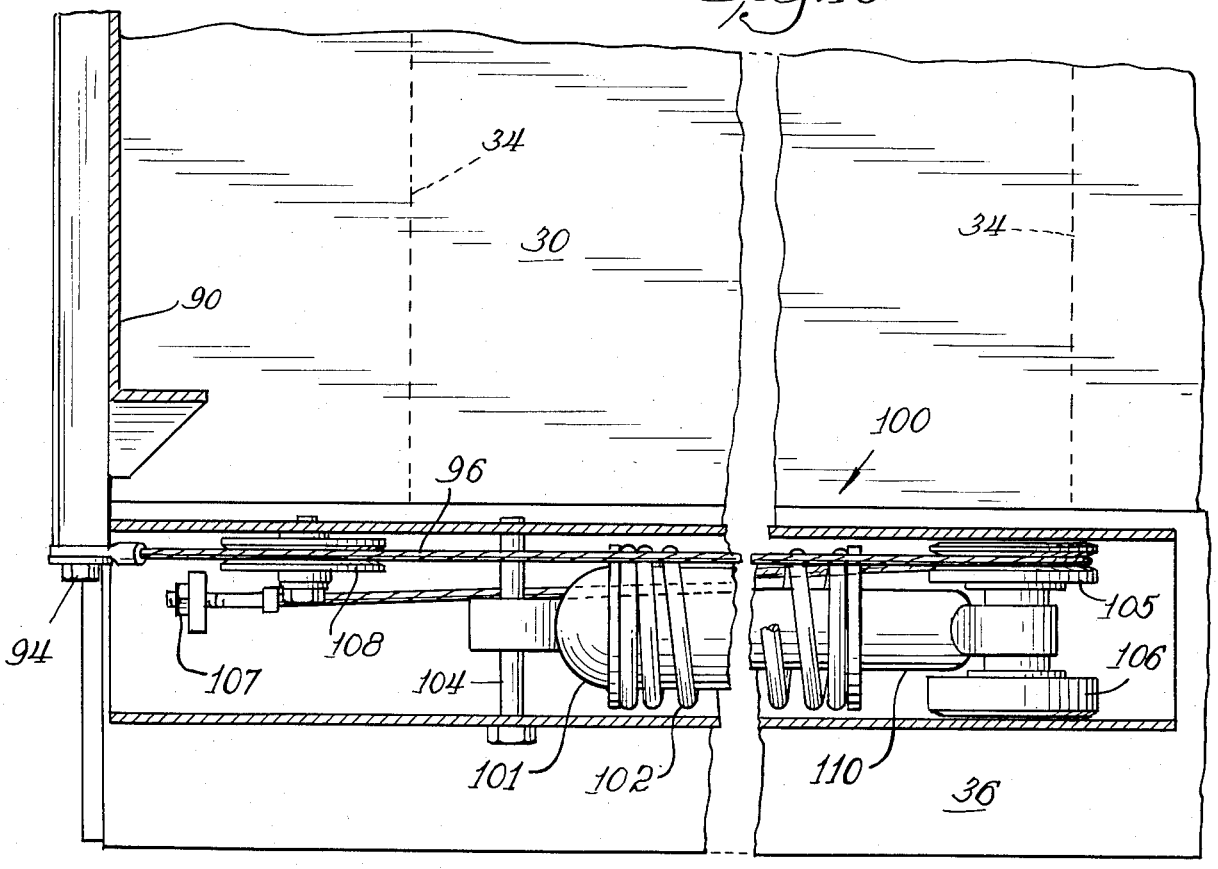
FIG. 18 is a partial sectional plan view of the bridge retractor assembly, as viewed along the line 18—18 in FIG. 17.

The lifting cables 96 connect the bridge 90 to the two automatic retractor assemblies 100. As seen in FIGS. 17 and 18, each of the retractor assemblies 100 includes an overload shock absorber which comprises a coil spring 102 which acts to extend the shock absorber, and a hydraulic dashpot 101 to dampen the action of the spring 102. A suitable overload shock absorber is the "E-Z Ride" shock absorber model SRM-187, produced by the Monroe Corporation of Monroe, Mich. One end of this shock absorber comprises a telescoping ram 110 which is fixed within the assembly 100 by a pin 104. The opposite end of the shock absorber includes a cable pulley 105 and a roller 106. During the operation of the retractor 100, the roller 106 guides the pulley 105 so that the pulley travels in a linear path within the unit 100. As seen in FIGS. 17 and 18, the lifting cable 96 is extended around the pulley 105 and has its free end fixed within the unit 100 by an adjustable lock nut 107. The cable 96 also is guided by a fixed pulley 108 which is pivotally mounted adjacent the open end of the assembly 100.

The retractor assemblies 100 operate to automatically raise the bridge 90 at the appropriate times during the cycle of operation of the lift 10. First, when the lift 10 is being raised to the level of the bed of the truck T (FIG. 2), the assemblies 100 hold the bridge 90 in its raised position by means of the force applied to the lifting cables 96 by the shock absorbers. As shown in FIGS. 1 and 8, the bridge 90 will thereby clear the sill of the truck T as the platform 30 is elevated into position. Once the platform 30 reachs its loading position with respect to the truck T, as shown in FIG. 2, the bridge 90 can be lowered into engagement with the truck bed. This lowering action can be accomplished by the operator applying a force to the bridge sufficient to overcome the holding force of the coil springs 102. When the bridge 90 passes the position of about 45° from vertical, the weight of the bridge causes the bridge to continue its downward motion. The dampening action of the shock absorbers slows down this lowering of the bridge 90 and cushions the impact of the bridge with the bed of the truck T.

Due to the arrangement of the retractor assemblies 100, the weight of the lowered bridge 90 is sufficient to overcome the lifting force of the springs 102 in the shock absorbers, when the bridge is in this lowered position. As shown in FIG. 2, the connecting bolts 94 are then positioned below the horizontal position of the pivot point 92. This arrangement reduces the size of the moment arm through which the lifting cables 96 act on the bridge 90. As a result, the lifting force of the shock absorbers in the assemblies 100 is substantially neutralized when the connecting bolts 94 drop below the horizontal level of the bridge pivot point 92.

The retractor assemblies 100 operate to automatically lift the bridge 90 from its lowered position, shown in FIG. 1, after the loading of the lift 10 has been completed. This automatic retraction is initiated by the lowering of the platform 30. As the platform 30 descends, the bed of the truck T forces the bridge 90 to pivot upwardly about the pivot point 92. The pivotal movement of the connecting bolts 94 brings the bolts increasingly into alignment with the shock absorber. This motion also increases the moment arm between the bolts 94 and the pivot 92 through which a lifting force is applied to the bridge 90 by the cables 96. The lifting force thereby created by the springs 104 in the shock absorbers increases progressively once the bolts 94 pass the horizontal plane of the pivot point 92. At the same time, the downward movement to the force of gravity on the bridge 90 is progressively decreasing as the pivoting of the bridge decreases the moment arm between the pivot point 92 and the center of gravity of the bridge. When the bridge reaches an angle of approximately 45° from its horizontal position, the balance of forces on the bridge reach a point where the lifting force of the shock absorbers predominate. The retractor assemblies 100 thereby continue to lift the bridge 90 upwardly into its fully retracted positon, as shown in FIGS. 1 and 17. The dampening action of the dashpots 101 causes the bridge 90 to proceed slowly and smoothly into its fully retracted and elevated position.

It will be appreciated by those skilled in the art that the foregoing description of an illustrative embodiment is given only by way of example. Various changes in the pallet lifting dock of this invention can be made without departing from the spirit and scope of the invention, as set forth in the following claims.

What is claimed is:

1. In an ambulatory dock lift having a base and a loading platform which can be vertically raised and lowered with respect to said base, the improvement comprising a retractable throw-over bridge system for joining the loading platform to an adjacent loading surface such as a truck bed or the like, said bridge system comprising:

an elongate bridge member joined at a pivot point to one end of said loading platform and being pivotal between an upright retracted position and a lowered position, and having a selected length so that said bridge member will span a selected space between the loading platform and an adjacent loading surface;

a bridge retractor assembly joining said bridge member to said platform, said retractor assembly being connected to said bridge member at a selected lifting point and including biasing means adapted for applying a lifting force to said bridge member to pivot said bridge member upwardly starting from a position intermediate said retracted and lowered positions to said upright retracted position thereby providing a stop gate across said one end of said loading platform;

said bridge retractor assembly and bridge member being arranged so that said lifting force is initially insufficient to pivot said bridge member upwardly from said lowered position and becomes sufficient to pivot said bridge member automatically to said retracted position when, through external forces, said bridge member is pivoted upwardly and reaches said intermediate positon;

connecting means for joining said biasing means to said bridge member at said lifting point; and dampening means associated with said biasing means for dampening the pivotal movement of said bridge member as said member moves toward either said retracted or said lowered position.

2. In an ambulatory dock lift having a base and a loading platform which can be vertically raised and lowered with respect to said base, the improvement comprising a retractable throw-over bridge system for joining the loading platform to an adjacent loading surface such as a truck bed or the like, said bridge system comprising:

an elongate bridge member joined at a pivot point to one end of said loading platform and being pivotal between an upright retracted position and a lowered position, and having a selected length so that said bridge member will span a selected space between the loading platform and an adjacent loading surface;

a bridge retractor assembly joining said bridge member to said platform, said retractor assembly being connected to said bridge member at a selected lifting point and including biasing means adapted for applying a lifting force to said bridge member to pivot said bridge member upwardly starting from a position intermediate said retracted and lowered positions to said upright retracted position thereby providing a stop gate across said one end of said loading platform;

said bridge retractor assembly and bridge member being arranged so that said lifting force is initially insufficient to pivot said bridge member upwardly from said lowered position and becomes sufficient to pivot said bridge member automatically to said retracted position when, through external forces, said bridge member is pivoted upwardly and reaches said intermediate positon;

connecting means for joining said biasing means to said bridge member at said lifting point;

dampening means associated with said biasing means for dampening the pivotal movement of said bridge member between said retracted position and said lowered position; and said retractor assembly comprising an overload shock absorber which incorporates said biasing means and said dampening means.

3. An ambulatory dock lift in accordance with claim 2 wherein a lifting point is provided on each lateral side of said bridge member and a bridge retractor assembly is positioned on each side of said platform and is joined to the associated lifting point on said bridge by a separate connecting means.

4. A dock lift in accordance with claim 2 wherein said connector comprises a cable and said retractor assembly includes a roller guide associated with said pulley means to guide the movement of said pulley means and shock absorber.

5. In an ambulatory dock lift having a base and a loading platform which can be vertically raised and lowered with respect to said base, the improvement comprising a retractable throw-over bridge system for joining the loading platform to an adjacent loading surface such as a truck bed or the like, said bridge system comprising:

an elongate bridge member joined at a pivot point to one end of said loading platform and being pivotal between an upright retracted position and a lowered position, and having a selected length so that said bridge member will span a selected space between the loading platform and an adjacent loading surface;

a bridge retractor assembly joining said bridge member to said platform, said retractor assembly being connected to said bridge member at a selected lifting point and including biasing means adapted for applying a lifting force to said bridge member to pivot said bridge member upwardly starting from a position intermediate said retracted and lowered positions to said upright retracted position thereby providing a stop gate across said one end of said loading platform;

said bridge retractor assembly and bridge member being arranged so that said lifting force is initially insufficient to pivot said bridge member upwardly from said lowered position and becomes sufficient to pivot said bridge member automatically to said retracted position when, through external forces, said bridge member is pivoted upwardly and reaches said intermediate positon;

connecting means for joining sad biasing means to said bridge member at said lifting point;

dampening means associated with said biasing means for dampening the pivotal movement of said bridge member between said retracted position and said lowered position; and said connecting means comprising an elongated connector and wherein said retractor assembly comprises an overload shock absorber having spring means to apply a biasing force in a selected direction to said connector, said assembly further including dashpot means to dampen said biasing force applied to said connector and pulley means to control the movement of said connector as said bridge member moves beween said retracted and lowered positions.

6. An ambulatory dock lift in accordance with claim 5 wherein a lifting point is provided on each lateral side of said bridge member and a bridge retractor assembly is positioned on each side of said platform and is joined to the associated lifting point on said bridge member by a separate connecting means.

7. An ambulatory dock lift in accordance with claim 6 wherein said connector comprises a cable and said retractor assembly includes a roller guide associated with said pulley means to guide the movement of said pulley means and shock absorber.

8. In an ambulatory dock lift having a base and a loading platform which can be raised and lowered with respect to said base, the improvement comprising a retractable throw-over bridge system for joining the loading platform to an adjacent loading surface such as a truck bed or the like, said bridge system comprising:

an elongate bridge member of a predetermined weight joined at a pivot point to one end of said loading platform and being pivotal between an upright retracted position through an intermediate position above the horizontal and lowered position below horizontal, and having a selected length so that said bridge member will span a selected space between the loading platform and an adjacent loading surface;

a bridge retractor assembly joining siad bridge member to said platform, said retractor assembly including biasing means for applying a lifting force to said bridge member at a selected lifting point to bias said bridge member upwardly toward said upright retracted position;

said lifting force of said biasing means being of a value in relation to the weight of said bridge member such that said lifting force is initially insufficient to pivot said bridge member upwardly from said lowered position and becomes sufficient to pivot said bridge member automatically to said retracted position when, through external forces, said bridge member is pivoted upwardly and reaches said intermediate position.

9. An ambulatory dock lift in accordance with claim 8 wherein said intermediate position for said bridge member is located approximately midway between said lowered and retracted positions.

10. An ambulatory dock lift in accordance with claim 9 wherein said intermediate position is between 30 degrees and 45 degrees above the horizontal position for said bridge member.

11. An ambulatory dock lift in accordance with claim 8, including dampening means associated with said biasing means for dampening the pivotal movement of said bridge member by said biasing means.

12. An ambulatory dock lift in accordance with claim 11 wherein said retractor assembly comprises an overload shock absorber which incorporates said biasing means and said dampening means.

13. An ambulatory dock lift in accordance with claim 11 wherein said dampening means includes means for dampening the movement of said bridge member as said member moves toward either said retracted or said lowered position.

14. In an ambulatory dock lift having a base and a loading platform which can be raised and lowered with respect to said base, the improvement comprising a retractable throw-over bridge system for joining the loading platform to an adjacent loading surface such as a truck bed or the like, said bridge system comprising:

an elongate bridge member of a predetermined weight joined at a pivot point adjacent one end thereof to one end of said loading platform and being pivotal between an upright retracted position through an intermediate position and a lowered position, and having a selected length so that said bridge member will span a selected space between the loading platform and an adjacent loading surface;

a bridge retractor assembly joining said bridge member to said platform, said retractor assembly including biasing means for applying an upward lifting force to said bridge member at a selected lifting point spaced outwardly of said pivot point to bias the bridge member upwardly toward said upright retracted position;

said lifting force of said biasing means being directed along a line constantly located above said pivot point at said one end of said bridge member when the bridge member is in any of said positions, and said lifting force being of a value in relation to the weight of said bridge member such that said lifting force is initially insufficient to pivot said bridge member upwardly from said lowered positon and becomes sufficient to pivot said bridge member automatically to said retracted position when, through external forces, said bridge member is pivoted upwardly and reaches said intermediate position.

15. An ambulatory dock lift in accordance with claim 14 wherein said intermediate position for said bridge member is located approximately midway between said lowered and retracted positions.

16. An ambulatory dock lift in accordance with claim 15 wherein said intermediate position is between 30 degrees and 45 degrees above the horizontal position for said bridge member.

17. An ambulatory dock lift in accordance with claim 14, including dampening means associated with said biasing means for dampening the pivotal movement of said bridge member by said biasing means.

18. An ambulatory dock lift in accordance with claim 17 wherein said retractor assembly comprises an overload shock absorber which incorporates said biasing means and said dampening means.

19. An ambulatory dock lift in accordance with claim 17 wherein said dampening means includes means for dampening the movement of said bridge member as said member moves toward either said retracted or said lowered position.

20. An ambulatory dock lift in accordance with claim 14, including connecting means for joining said biasing member to said bridge member at said lifting point, said connecting means comprising a cable and said retractor assembly includes guide means for directing said cable along said line located above said pivot point of the bridge member.

21. In a dock lift having a base and a loading platform which can be raised and lowered with respect to said base, the improvement comprising a retractable throw-over bridge system for joining the loading platform to an adjacent loading surface such as a truck bed or the like, said bridge system comprising:

an elongate bridge member of a predetermined weight joined at a pivot point to one end of said loading platform and being pivotal between an upright retracted position through an intermediate position above the horizontal and a lowered position below horizontal, and having a selected length so that said bridge member will span a selected space between the loading platform and an adjacent loading surface;

a bridge retractor assembly joining said bridge member to said platform, said retractor assembly including biasing means for applying a lifting force to said bridge member at a selected lifting point to bias said bridge member upwardly toward said upright retracted position;

said lifting force of said biasing menas being of a value in relation to the weight of said bridge member such that said lifting force is initially insufficient to pivot said bridge member upwardly from said lowered position and becomes sufficient to pivot said bridge member automatically to said retracted position when, through external forces, said bridge member is pivoted upwardly and reaches said intermediate position.

22. A dock lift in accordance with claim 21 wherein said intermediate position for said bridge member is located approximately midway between said lowered and retracted positions.

23. A dock lift in accordance with claim 22 wherein said intermediate position is between 30 degrees and 45 degrees above the horizontal position for said bridge member.

24. A dock lift in accordance with claim 21, including dampening means associated with said biasing means for dampening the pivotal movement of said bridge member by said biasing means.

25. A dock lift in accordance with claim 24 wherein said retractor assembly comprises an overload shock absorber which incorporates said biasing means and said dampening means.

26. A dock lift in accordance with claim 24 wherein said dampening means includes means for dampening the movement of said bridge member as said member moves toward either said retracted or said lowered position.

27. In a dock lift having a base and a loading platform which can be raised and lowered with respect to said base, the improvement comprising a retractable throw-over bridge system for joining the loading platform to an adjacent loading surface such as a truck bed or the like, said bridge system comprising:

an elongate bridge member of a predetermined weight joined at a pivot point adjacent one end thereof to one end of said loading platform and being pivotal between an upright retracted position through an intermediate position and a lowered position, and having a selected length so that said bridge member will span a selected space between the loading platform and an adjacent loading surface;

a bridge retractor assembly joining said bridge member to said platform, said retractor assembly including biasing means for applying an upward lifting force to said bridge member at a selected lifting point spaced outwardly of said pivot point to bias the bridge member upwardly toward said upright retracted position;

said lifting force of said biasing means being directed along a line constantly located above said pivot point at said one end of said bridge member when the bridge member is in any of said positions, and said lifting force being of a value in relation to the weight of said bridge member such that said lifting force is initially insufficient to pivot said bridge member upwardly from said lowered position and becomes sufficient to pivot said bridge member automatically to said retracted position when, through external forces, said bridge member is pivoted upwardly and reaches said intermediate position.

28. A dock lift in accordance with claim 27 wherein said intermediate position for said bridge member is located approximately midway between said lowered and retracted positions.

29. A dock lift in accordance with claim 28 wherein said intermediate position is between 30 degrees and 45 degrees above the horizontal position for said bridge member.

30. A dock lift in accordance with claim 27, including dampening means associated with said biasing means for dampening the pivotal movement of said bridge members by said biasing means.

31. A dock lift in accordance with claim 30 wherein said retractor assembly comprises an overload shock absorber which incorporates said biasing means and said dampening means.

32. A dock lift in accordance with claim 30 wherein said dampening means includes means for dampening the movement of said bridge member as said member moves toward either said retracted or said lowered position.

33. A dock lift in accordance with claim 27, including connecting means for joining said biasing member to said bridge member at said lifting point, said connecting means comprising a cable and said retractor assembly includes guide means for directing said cable along said line located above said pivot point of the bridge member.

* * * * *